US006470887B1

(12) United States Patent
Martinez

(10) Patent No.: US 6,470,887 B1
(45) Date of Patent: Oct. 29, 2002

(54) PROTECTIVE BREATHING EQUIPMENT WITH FAST POSITIONING

(75) Inventor: Patrice Martinez, Le Perray en Yvelines (FR)

(73) Assignee: Intertechnique, Plaisir, Cedex (FR)

( * ) Notice: Subject to any disclaimer, the term of this patent is extended or adjusted under 35 U.S.C. 154(b) by 0 days.

(21) Appl. No.: 09/700,117

(22) PCT Filed: May 7, 1999

(86) PCT No.: PCT/FR99/01087

§ 371 (c)(1),
(2), (4) Date: Jan. 2, 2001

(87) PCT Pub. No.: WO99/58197

PCT Pub. Date: Nov. 18, 1999

(30) Foreign Application Priority Data

May 12, 1998 (FR) ..... 98 05949

(51) Int. Cl.[7] ..... A62B 18/08

(52) U.S. Cl. ..... 128/207.11; 128/202.27; 128/206.27

(58) Field of Search ..... 128/202.27, 206.27, 128/207.11, DIG. 26, 205.24; 137/38, 39, 908, 81.1; 285/299, 300, 301, 924

(56) References Cited

U.S. PATENT DOCUMENTS 3,599,636 A * 8/1971 Gutman ..... 128/207.11
3,752,175 A * 8/1973 Hamilton et al. ..... 137/81
3,792,702 A * 2/1974 Delest ..... 128/207.11
3,990,757 A * 11/1976 Gill ..... 439/190
4,183,372 A * 1/1980 Ueda et al. ..... 137/81
4,350,321 A * 9/1982 Berg ..... 251/149.6
4,437,462 A * 3/1984 Piljay et al. ..... 128/207.11
4,567,909 A * 2/1986 Schebler et al. ..... 137/81.1
4,915,106 A * 4/1990 Aulgur et al. ..... 128/207.11
5,003,632 A * 4/1991 Claude ..... 2/6
5,036,846 A * 8/1991 Aulgur et al. ..... 128/207.11
5,357,654 A * 10/1994 Hsing-Chi ..... 24/68 B
5,488,948 A 2/1996 Dubruille et al.
5,503,147 A * 4/1996 Bertheau ..... 128/207.11
5,535,985 A * 7/1996 Larbuisson ..... 251/149.9
5,623,923 A * 4/1997 Bertheau et al. ..... 128/207.11
5,630,412 A * 5/1997 Dubruille et al. ..... 128/206.23
5,664,566 A * 9/1997 McDonald et al. .... 128/205.25
5,690,102 A * 11/1997 Bertheau et al. ..... 128/207.11
5,771,886 A * 6/1998 Maire et al. ..... 128/207.11
5,941,245 A * 8/1999 Hannah et al. ..... 128/207.11
5,957,132 A * 9/1999 McDonald et al. .... 128/207.11
6,039,045 A * 3/2000 Bertheau et al. ..... 128/207.11
6,070,580 A * 6/2000 McDonald et al. .... 128/207.11

* cited by examiner

*Primary Examiner*—Dennis Ruhl
*Assistant Examiner*—Joseph F. Weiss, Jr.
(74) *Attorney, Agent, or Firm*—Larson & Taylor PLC

(57) ABSTRACT

Protective breathing equipment comprises a breathing mask provided with a regulator for connection to a source of pressurized breathing gas and a harness having at least one extensible strap whose ends are connected to the mask and which includes an element that is temporarily inflatable by the pressurized gas to lengthen the strap until it is large enough to enable the user to engage the harness on the head, and exhaustible to allow the strap to press to press the mask against the face. The extensible strap is connected to the face-piece by at least one mechanical member of length that is adjustable by the user while wearing the equipment.

9 Claims, 2 Drawing Sheets

PROTECTIVE BREATHING EQUIPMENT WITH FAST POSITIONING

The invention relates to protective breathing equipment comprising a breathing mask, a harness enabling it to be put quickly into place on the face, and sometimes also goggles for providing protection against smoke, and optionally integrated with the mask.

Protective breathing equipment that can be donned quickly is already known (EP-A-0 288 391), in particular for the technical crew of passenger carrying airplanes, the equipment comprising a breathing mask provided with a regulator for connection to a source of pressurized breathing gas (generally oxygen) and a harness having at least one extensible strap whose ends are connected to the mask and which includes an element that is temporarily inflatable by the pressurized gas to lengthen the strap until it is large enough to enable the user to engage the harness on the head, and can be scavenged to cause the strap to tighten so as to press the mask against the face and hold it in place.

The equipment described by way of example in document EP 0 288 391 enables the pressure in the inflatable element to be adjusted so as to give it a value between the complete deflation pressure and the fully inflated pressure so as to reduce the discomfort created by wearing the mask continuously under conditions of flight that make it compulsary to wear the mask.

That solution is entirely satisfactory from the comfort point of view. However, it complicates the pressure control means. Furthermore, inevitable leaks, e.g. due to the porosity of the inflatable element, lead to breathing gas under pressure being consumed during periods while the mask is being used in the "comfort" position.

The present invention seeks in particular to provide protective breathing equipment that provides a degree of comfort at least equivalent to that of existing equipment during periods in which the mask is worn while there is no need to press it hard against the face to overcome the high pressure of the breathing gas, and that reduces breathing gas consumption during these periods.

For this purpose, the invention provides in particular equipment of the above-defined kind, in which the extensible strap is connected to the face-piece via at least one mechanical member of length that is adjustable by the user while wearing the equipment.

The mechanical member may be constituted by a rack fixed to one end of the strap and a pawl carried by the face-piece, allowing the strap and the face-piece to move relative to each other in the tightening direction, the pawl being releasable to allow the rack to move in the opposite direction. This disposition can be inverted, with the rack then being fixed to the face-piece.

The pneumatic connection between the face-piece, which carries the means controllable by the user for inflating the inflatable element, and said inflatable element is designed to allow for relative sliding. In order to ensure that the inflation command causes the rack to come into its position of maximum tightness, this result can be achieved by extending the rack by a hollow piston that is movable in a cylinder fast with the face-piece. The piston then divides the cylinder into two compartments, one of which is connected to the inflation feed for the inflatable element and the other of which is connected to the atmosphere.

The protection equipment can be associated with an aneroid capsule constituting an altitude detector for automatically causing the cylinder compartment to be put at the pressure which gives rise to maximum tightening in the event of depressurization of the environment.

The above features and others will appear more clearly on reading the following description of particular embodiments given as non-limiting examples.

The description refers to the accompanying drawings, in which.

Figure 1:
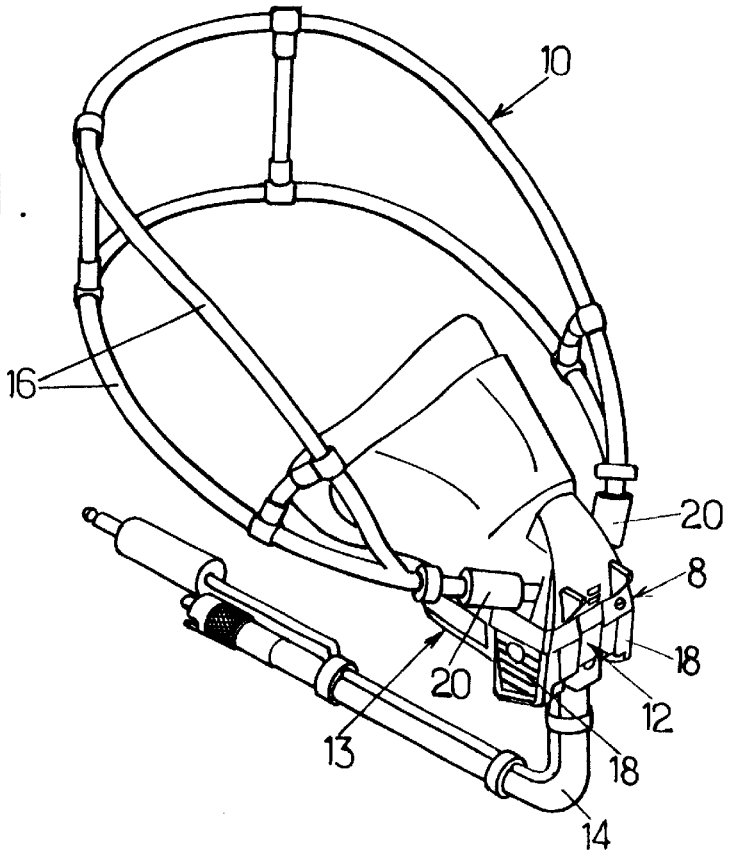
FIG. 1 is a perspective view showing the outer appearance of protective equipment suitable for implementing the invention.
Figure 2:
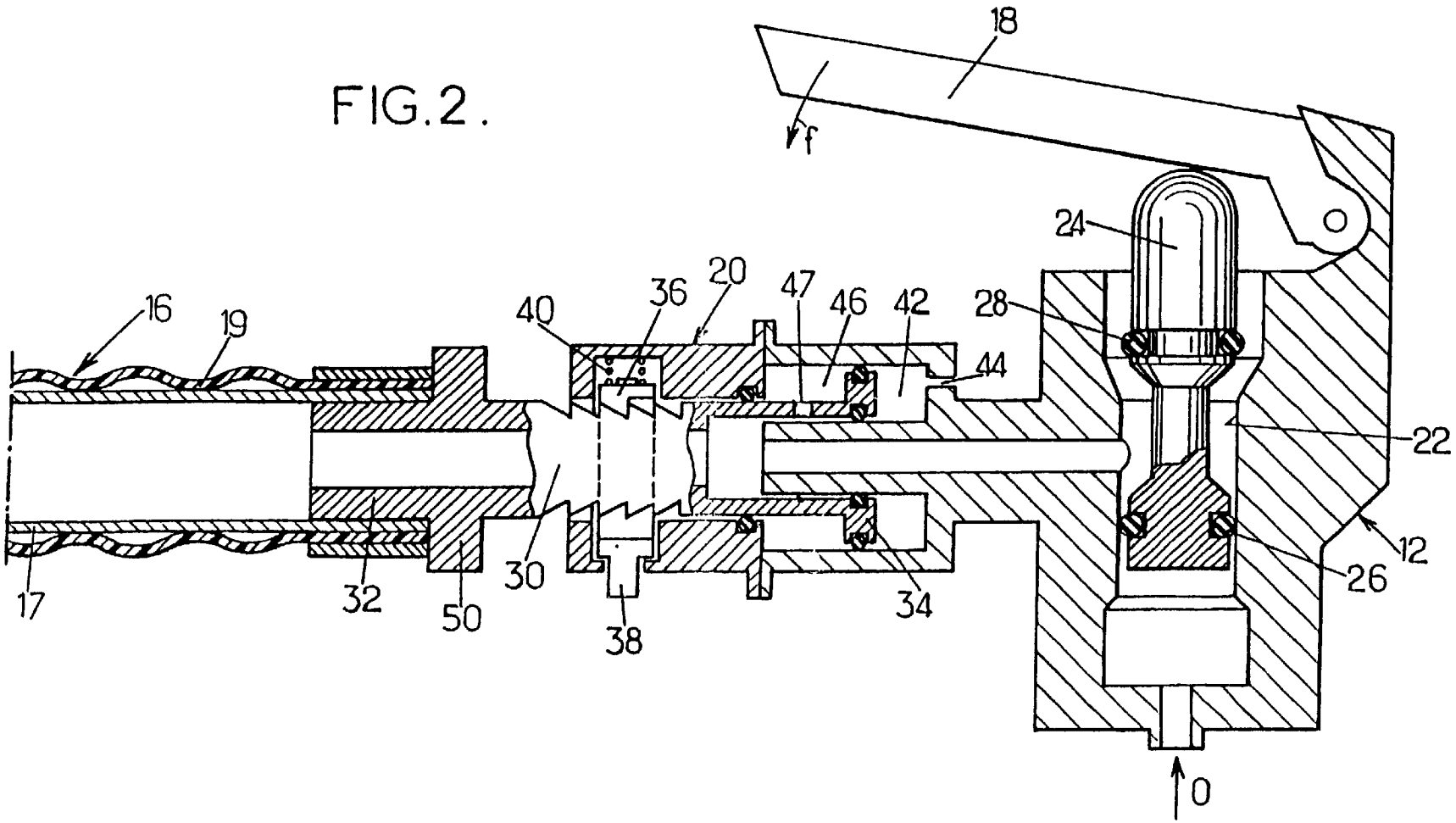
FIG. 2 is a diagrammatic section view on a larger scale showing the components of the equipment that enable the equipment to be donned quickly and that enable the pressure with which the mask is pressed against the face to be adjusted.

The emergency breathing equipment shown in FIG. 1 is shown in the conditions when the harness is inflated, and it can be considered as comprising a mask 8 and a harness 10. The mask shown has an oral-nasal face-piece which is fixed to a demand regulator 13 and to a rigid connection block 12. The connection block is provided with a coupling for connection with a flexible hose 14 for connection to a source of pressurized breathing gas (generally oxygen). The harness shown has two straps 16, each having an inner tube 17 made of a material that allows the tube to lengthen and contained in an inextensible sheath 19 that limits the extent to which the tube can lengthen (FIG. 2). Depending on the intended use, the regulator can operate with or without dilution with air drawn from the cockpit, and with or without an option to be put under positive relative pressure.

The regulator is connected to the feed hose 14 via the connection block 12. The block carries means for manually controlling inflation of the straps 16, e.g. constituted by a cock designed to be actuated by manually squeezing together two lugs 18 carried by the connection block 12, one of which lugs is mounted to tilt.

The cock is constituted in such a manner as to put a volume inside the connection block 12 and the straps 16 into communication with the atmosphere when it is free, thus allowing the straps to deflate and retract, thereby pressing the mask against the face. When the cock is actuated, it admits pressurized gas from the feed hose 14 into the inside volume, thereby causing the straps to lengthen sufficiently to enable the equipment to be donned quickly.

In accordance with the invention, at least one of the branches of the harness is connected to the demand regulator via a mechanical length-adjustment member. In the example shown in FIG. 1, two such members 20 are provided, each connecting one end of the harness to the regulator or to the connection block. The length of the inner tube 17 when in the relaxed condition is selected so as to ensure that the harness will still press the mask against the face with sufficient pressure when the adjustment member is at its minimum length, even for wearers having the smallest expected head size. It is generally accepted that the minimum round-the-head measurement is of 56 cm.

The cock enabling the harness to be completely inflated or scavenged can have the conventional structure shown in FIG. 2. In which case, there is a passage 22 in the housing of the rigid connection block 12 with a plunger 24 mounted in the passage to constitute a dual shut-off member. One end of the passage is connected to the inlet for pressurized breathing gas. The other end is open to the atmosphere. A first O-ring 26 carried by the plunger 24 bears against a cylindrical portion of the passage 22 and separates the gas inlet from an inside volume of the block so long as the plunger 24 is held by the admission pressure in contact with the lug 18 in rest position. When the lug 18 is moved manually in the direction shown by arrow f, it pushes the plunger to a position where it puts the gas inlet into communication with the inside volume. Simultaneously, the displacement of the plunger brings a second O-ring 28 to bear against a frustoconical portion of the passage and separates the inside volume from the atmosphere.

The adjustment member 20 includes a rack 30 extended by an endpiece 32 having an airtight connection with the end of the harness. At its end opposite from the endpiece 32, the rack is extended by an annular piston 34.

The portion of the adjustment member that is slidable relative to the rack is constituted by an arm of the housing 12 which houses a rack pawl 36 fitted with an unlocking pushbutton 38. A spring 40 urges the pawl 36 into a position where it engages the rack 30 and prevents it from moving in a direction that corresponds to lengthening the adjustment member. The arm of the housing also contains a cylinder which is divided by the annular piston 34 into a compartment 42 connected to the atmosphere via a port 44, and a second compartment 46.

The inside volume of the cock communicates with the tube 17 via holes in alignment formed through the arm of the housing, the rack 30, and the endpiece 32. A path 47 balances the pressure that exists in the compartment 46 with the pressure in the harness. O-rings carried by the piston 34 separate the compartments 42 and 46 in leakproof manner.

The equipment is used as follows.

Donning:

When the user desires to put on the mask which is then in its storage box, the user grasps the connection block 12, extracts it from the box, and squeezes the lugs 18 together.

Breathing gas is then admitted into the harness and, via passage 47, into compartment 46. The force exerted on the annular piston 34 moves it (to the right in FIG. 2) so as to bring the adjustment member into its minimum-length position. Once the user has placed the mask against his face, he releases the lugs 18. The mask is then pressed against the face with maximum force.

Reducing Tightness:

In order to reduce tightness, it suffices for the user to press briefly the pushbutton 38 to release the pawl 36 temporarily. The rack can then move backwards. As soon as the pushbutton 38 is released, the pawl 36 is driven by the spring 40 to lock the rack again.

Increasing Tightness:

To increase the tightness of the mask, it suffices to push in the rack, which can be provided with a collar 50 for this purpose.

If emergency tightening is necessary, it can be performed by pushing home the collar 50 of the adjustment member (or of each adjustment member). It is also possible to perform such tightening by fully inflating the harness by squeezing the lug 18. The compartment 46 is then pressurized and "resets" the rack by moving it into the rightmost position. As soon as the lug is released, the harness returns to its position of maximum tightness.

To make the adjustment more progressive, it is possible to replace the one-piece pawl 36 and pushbutton 38 unit by two pieces which are coupled together by a spring, and to provide the pushbutton with a ratchet that is capable of engaging in an appropriate set of teeth of the rack 30. This second set of teeth of the rack 30 allows an advance of one step only for each press on the pushbutton 38.

Removing the Mask:

When the user desires to put the mask back into its box, he inflates the harness fully by acting on the lug 18. The pressure in the compartment 36 automatically resets the rack. Once the mask has been removed, the user merely has to release the lug 18 for the harness to become flexible again and allow the mask to be stored in a state such that tightness will be maximum in the event of the equipment being put back on the head.

When two mechanical adjustment members are provided, only one of them needs to have a pneumatic connection with the straps.

Figure 3:
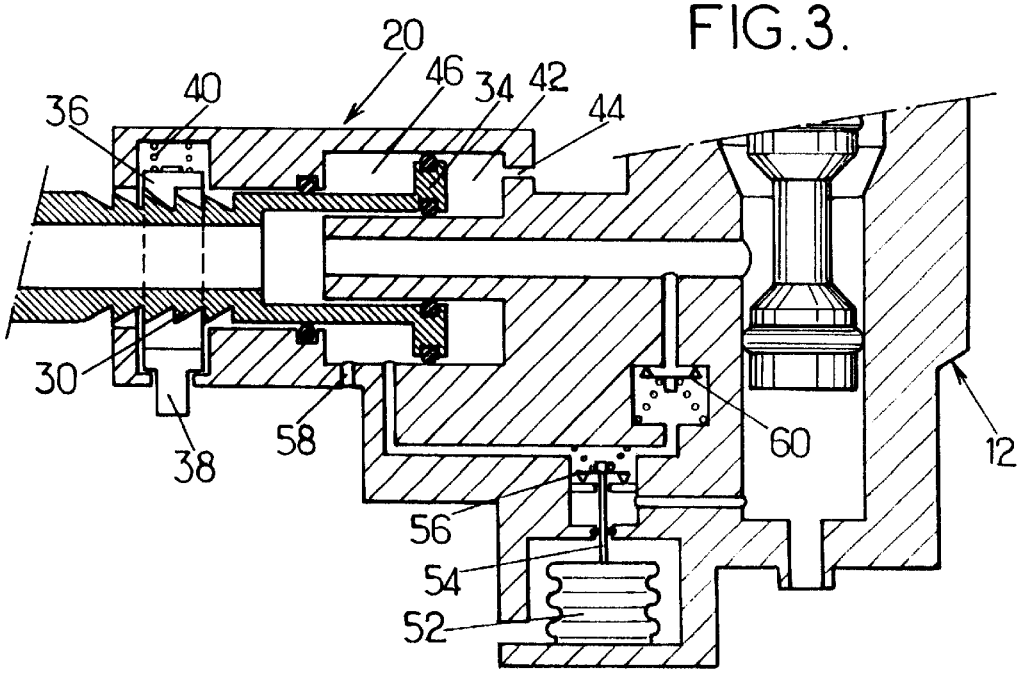
FIG. 3 is similar to a fraction of FIG. 2 and shows a modified embodiment.

FIG. 3 shows a modified embodiment which gives rise to maximum tightness in the event of depressurization. In FIG. 3 some of the elements already shown in FIG. 2 are designated by the same reference numerals. Emergency tightening is caused by pressurization of compartment 46 caused by a barometer capsule 52. This capsule is subjected to ambient pressure. It is provided with a push rod 54 which forces opening of a valve 56 when ambient pressure drops below a predetermined value. The valve 56 then communicates the pressurized breathing gas inlet with the compartment 46 that is connected to the atmosphere via a constriction 58 that allows the compartment 46 subsequently to deflate slowly. A check valve 60 connects the downstream side of the valve 56 to the internal volume of the housing 12 and to the harness so as to avoid gas escape to the surrounding air.

In the event of depressurization while the rack is in an intermediate position, the capsule causes the compartment 46 to be put under pressure and causes full reset of the rack. The constriction 58 allows the pressure in the compartment 46 to drop only from the moment when it is no longer fed from the valve 56. The check valve 60 prevents flow to the surrounding air while the compartment 46 is being pressurized.

What is claimed is:

1. A protective breathing equipment comprising:

(a) a breathing mask adapted to be pressed against a user's face and provided with a regulator for connection to a source of pressurized breathing gas; and (b) a harness having at least one strap having opposite ends a length and two connected to the mask, said strap including:

an inflatable resilient element which is temporarily fully inflatable by the pressurized breathing gas from said source to lengthen the strap until said harness is large enough to enable donning of the harness over a user's head and fully deflatable to allow the strap to tighten due to resiliency of said inflatable resilient element so as to press the mask against the user's face and hold said mask in place, at least one mechanical ratchet member between one of said ends of said strap member and said mask, said mechanical ratchet member having a length which is manually adjustable, by steps, from a maximum length up to a minimum length while wearing the equipment, and which is arranged for being brought in a condition of said minimum length responsive to full inflation of the inflatable element.

2. The protective breathing equipment according to claim 1, wherein said mechanical ratchet member comprises a rack fixed to one of the ends of the strap and a pawl carried by a face-piece of said mask, said mechanical ratchet member thus allowing the strap and the face-piece to move relative to each other in a tightening direction for shortening the length of said harness with the pawl being manually releasable to allow the rack to fully move in the direction opposite to the tightening direction.

3. The protective breathing equipment according to claim 1, wherein the pawl is releasable by a pushbutton acting against a spring.

4. A protective breathing equipment comprising:

(a) a breathing mask adapted to be applied upon a user's face and provided with a regulator for connection to a source of pressurized breathable gas, said mask including a face-piece;

(b) a harness having at least one resilient strap with opposite a length and two ends connected to the mask, said harness including an inflatable element that is (i) temporarily fully inflatable by the pressurized breathable gas from said source responsive to a manual actuation to lengthen the strap until the strap is large enough for donning said harness over a user's head and (ii) fully deflatable to allow the strap to tighten due to resiliency of said inflatable resilient element so as to press the mask against the user's face and hold said mask in place; and (c) a mechanical member which connects said strap to the mask, said mechanical member having a length that is manually adjustable between a minimum length and a maximum length, and which said strap is arranged for being brought into a condition of the minimum length responsive to full inflation of the inflatable element, said mechanical member including a rack fixed to one of the ends of the strap and a pawl carried by the face-piece allowing the strap and the face-piece to move relative to each other in a tightening direction for shortening the length of said strap with the pawl being manually releasable to allow the rack to fully move in the direction opposite to the tightening direction, and a hollow annular piston and an associated cylinder in which said piston moves, said cylinder being secured to the face-piece and said piston being used for extending the rack, the piston subdividing the cylinder into first and second compartments, the first compartment being connected to a feed for the pressurized breathable gas used to inflate said inflatable element and the second compartment being provided with a calibrated leak to atmosphere, wherein pressurizing the first compartment with the pressurized breathable gas causes the rack to be moved.

5. The protective breathing equipment according to claim 4, further including an aneroid capsule constituting an altitude detector and automatically delivering pressurized breathing gas from said source to the first compartment of the cylinder to cause maximum tightening responsive to depressurization of an environment.

6. The protective breathing equipment according to claim 5, when the aneroid capsule controls a valve for putting the first compartment into communication with the source of pressurized breathing gas.

7. A protective breathing equipment comprising:

(a) a breathing mask provided with a face-piece adapted to be pressed on a user's face and with a regulator for connection to a source of pressurized breathing gas; and (b) a harness having:

at least one strap having opposite ends connected to the face-piece and which includes an element that is (i) temporarily fully inflatable by the pressurized gas from said source to lengthen the strap until said harness is large enough to enable donning of the harness over a user's head, and (ii) fully deflatable to allow the strap to tighten due to resiliency of said element so as to force the mask against the user's face and hold said mask in place, and at least one mechanical member connecting at least one of the ends of the strap to the mask, said mechanical member having a length that is manually adjustable while wearing the equipment, said mechanical member having a rack fixed to one of the ends of the strap and a pawl carried by the mask for constituting a rack and pawl connection allowing the strap and the mask to be moved relative to each other in a tightening direction responsive to a manual force exerted by a user and forcing said face-piece to more strongly seal to the user's face, said pawl being manually releasable to allow the rack to move in a direction opposite to said tightening direction.

8. The protective breathing equipment according to claim 7, further including an aneroid capsule for automatically tightening the mechanical member responsive to depressurization of an environment.

9. A protective breathing equipment comprising:

(a) a breathing mask provided with a face cover arranged for contact with a user's face and with a regulator for connecting to a source of pressurized breathing gas; and (b) a harness having:

at least one strap having opposite ends connected to the mask and which includes an inflatable and deflatable element that is (i) temporarily fully inflatable with said pressurized breathing gas from said source upon actuation of a manually controlled means to lengthen the strap to a length sufficient to enable donning of the harness over a user's head and (ii) fully deflated upon release of said manually controlled means to allow the strap to resiliently shorten and to exert a resilient force pressing the face cover against the user's face, a mechanical member connecting at least one of the ends of the strap to the mask, comprising (i) a rack and a pawl mechanism having a length adjustable at a plurality of different discrete values between a minimum length and a maximum length, said mechanism being shortened responsive to a manual force exerted by a user and biasing a rack of said rack and pawl mechanism and an element carrying a pawl of said rack and pawl mechanism towards each other while the breathing equipment is worn and being lengthened upon temporary release of said pawl from said rack by the user, and (ii) means, subjected to a pressure prevailing in said inflatable and deflatable element, for exerting a pressure force sufficient to bring the length of said rack and pawl mechanism to said minimum length against said resilient force upon inflation of said inflatable and deflatable element.

* * * * *